US010273770B2

(12) United States Patent
Van Der Ende

(10) Patent No.: US 10,273,770 B2
(45) Date of Patent: Apr. 30, 2019

(54) SYSTEM FOR PERFORMING AN OPERATION WITHIN AN ELONGATED SPACE

(71) Applicant: PARADIGM TECHNOLOGY SERVICES B.V., Groot-Ammers (NL)

(72) Inventor: Andre Martin Van Der Ende, Udny Green (GB)

(73) Assignee: PARADIGM TECHNOLOGY SERVICES V.B., Groot-Ammers (NL)

( * ) Notice: Subject to any disclaimer, the term of this patent is extended or adjusted under 35 U.S.C. 154(b) by 377 days.

(21) Appl. No.: 15/024,471

(22) PCT Filed: Sep. 26, 2014

(86) PCT No.: PCT/EP2014/070620
§ 371 (c)(1),
(2) Date: Mar. 24, 2016

(87) PCT Pub. No.: WO2015/044346
PCT Pub. Date: Apr. 2, 2015

(65) Prior Publication Data

US 2016/0215579 A1 Jul. 28, 2016

(30) Foreign Application Priority Data

Sep. 27, 2013 (GB) ..... 1317201.0

(51) Int. Cl.
*E21B 23/14* (2006.01)
*E21B 47/12* (2012.01)
(Continued)

(52) U.S. Cl.
CPC ..... *E21B 23/14* (2013.01); *E21B 41/0085* (2013.01); *E21B 47/12* (2013.01); *E21B 2023/008* (2013.01)

(58) Field of Classification Search
None
See application file for complete search history.

(56) References Cited

U.S. PATENT DOCUMENTS 2,370,818 A * 3/1945 Silverman ..... E21B 17/003 175/40
2,727,722 A 12/1955 Conboy
(Continued)

FOREIGN PATENT DOCUMENTS

DE 10001334 A1 7/2001
EP 2270311 A2 1/2011
(Continued)

OTHER PUBLICATIONS

Search Report for Appl. No. GB1600226.3; dated Jan. 29, 2016; 3 pages.
(Continued)

*Primary Examiner* — Shane Bomar
(74) *Attorney, Agent, or Firm* — William H. Honaker; Dickinson Wright PLLC

(57) ABSTRACT

A system for performing an operation in a wellbore comprises a tool (4) configured for deployment within the wellbore on an insulated slickline (6), and a winch (26) for hauling in and/or paying out the slickline. The system further comprises a winch controller (34) which is configured to receive information transmitted electrically from the tool along the slickline and to control the winch according to the received information. The tool may comprise a downhole tractor. The tool may comprise an electrical generator tool or a tool for performing a mechanical operation within the wellbore.

34 Claims, 6 Drawing Sheets

(51) Int. Cl.
*E21B 41/00* (2006.01)
*E21B 23/00* (2006.01)

(56) References Cited

U.S. PATENT DOCUMENTS

| | | | | |
|---|---|---|---|---|
| 3,554,284 | A * | 1/1971 | Nystrom | E21B 23/14 166/254.2 |
| 4,192,380 | A * | 3/1980 | Smith | E21B 17/1021 166/104 |
| 4,473,196 | A * | 9/1984 | Sammann | B65H 54/56 242/390.5 |
| 4,676,310 | A * | 6/1987 | Scherbatskoy | E21B 23/10 166/113 |
| 4,875,661 | A * | 10/1989 | Langston | E02F 5/10 254/134.3 FT |
| 5,018,451 | A | 5/1991 | Hapstack | |
| 5,697,459 | A * | 12/1997 | Sher | A61B 17/320758 175/106 |
| 6,012,707 | A * | 1/2000 | Enlund | B66D 1/44 254/323 |
| 6,216,789 | B1 * | 4/2001 | Lorsignol | B66D 1/505 166/355 |
| 6,345,669 | B1 | 2/2002 | Buyers et al. | |
| 7,000,903 | B2 * | 2/2006 | Piecyk | E21B 19/08 166/355 |
| 2005/0284233 | A1 | 12/2005 | Teraura et al. | |
| 2006/0044155 | A1 | 3/2006 | Le Briere et al. | |
| 2006/0244628 | A1 | 11/2006 | Bausov et al. | |
| 2007/0007016 | A1 | 1/2007 | Sanderlin | |
| 2008/0264643 | A1 * | 10/2008 | Skeels | E21B 33/076 166/348 |
| 2013/0160995 | A1 | 6/2013 | Ocalan et al. | |

FOREIGN PATENT DOCUMENTS

| | | | |
|---|---|---|---|
| GB | 2399110 | A | 9/2004 |
| WO | 9924691 | A1 | 5/1999 |
| WO | WO02059451 | A1 | 8/2002 |
| WO | 20050061944 | A1 | 7/2005 |
| WO | 2007008637 | A1 | 1/2007 |
| WO | WO2013098280 | A2 | 7/2013 |

OTHER PUBLICATIONS

International Search Report and Written Opinion dated Sep. 30, 2015 in International Patent Application No. PCT/EP2014/070620.
International Search Report; Appl No. GB1317201.0; dated Mar. 25, 2014; 2 pages.

* cited by examiner

SYSTEM FOR PERFORMING AN OPERATION WITHIN AN ELONGATED SPACE

CROSS REFERENCE TO RELATED APPLICATIONS

This application claims the benefit of PCT International Application Serial No. PCT/EP2014/070620 filed on Sep. 26, 2014, which claims priority to GB 1317201.0 filed on Sep. 27, 2013, the entire disclosures of which are incorporated herein by reference.

FIELD OF INVENTION

The present invention relates to a system for performing an operation within an elongated space and, in particular though not exclusively, for performing an operation in an elongated space defined by or within a wellbore of an oil and gas well.

BACKGROUND TO INVENTION

Downhole tools or tool strings are commonly deployed in oil and gas wells for a variety of reasons, for example to perform a well operation such as a remedial operation and/or to perform downhole measurements. It is known to lower or run a downhole tool for such purposes into position within a wellbore on the end of a support member or line and/or to recover the downhole tool to surface by hauling in the support member or line.

Some downhole tools require power to perform or enhance their function. Power may be provided in mechanical, electrical, magnetic and/or chemical form. For example, electrical power may be provided to a downhole tool either by transmission along an electrically conductive wireline or from a downhole battery.

In addition to being used for the transmission of electrical power from surface to a downhole tool, electrically conductive wirelines may also be used for electrical communications between the downhole tool and surface, for example for the electrical transmission of well logging data to surface. Electrically conductive wirelines generally have a steel wire outer armour consisting of one or more layers of helically twisted steel wires around an electrically insulated core of one or more electrical conductors. Such conventional wirelines present a sealing hazard against the well pressure at surface since gas pressure may migrate in the interstitial voids of the armour. Accordingly, wireline operations are generally costly and involve a surface sealing safety risk.

Mechanical power can be delivered by steel cables such as swabbing lines or slicklines. Slicklines have a smooth outer surface against which well pressure sealing at surface can be simply and safely performed by stuffing box sealing glands. Slicklines have conventionally been used to mechanically support and transport downhole tools. In addition, slicklines have been used to transfer mechanical power to downhole tools from a winch located at surface. However, slicklines are not suitable for the transfer of electric power. Accordingly, downhole tools which require electric power but which are configured for use with slickline are generally provided with their own batteries.

Downhole conditions are hostile to battery performance. Thus, it is generally necessary to protect batteries from hostile downhole conditions by housing the batteries in sealed enclosures. This limits the available space for the batteries and thus limits the power available downhole. The size and shape of the battery enclosure is generally constrained by the geometry of a lubricator located at the wellhead and the inside diameter of the casing tubular through which the downhole tool must pass. Furthermore, the high downhole temperatures limit the electrical power storage and output capacity of the batteries. To safeguard downhole operations, it is also important to be able to monitor the battery performance and control the consumption of battery power.

In deviated oil and gas wells, it may not be possible to lower a downhole tool to a desired position. This is particularly true in highly deviated oil and gas wells where a deviated section of the wellbore may extend in a horizontal or near horizontal direction. Accordingly, it is known to use a downhole tractor to advance a downhole tool along a deviated section of an oil and gas wells. Conventional downhole tractors are typically either wheel-driven or are of the reciprocating or inchworm type. Wheel-driven tractors generally have wheels mounted on powered pivot arms which are pressed against the tubing inner walls. Reciprocating tractors generally include a forward body having forward clamp shoes and a rear body having rear clamp shoes. The forward and rear bodies are configured to reciprocate relative to one another. The forward and rear clamp shoes are alternately pressed against the inner wall of a tubular or a wellbore. The forward body is pushed in the downhole direction relative to the rear body against the rear clamp shoe or the rear body is pulled relative to the forward body against the forward clamp shoe to advance the rear body.

Known downhole tractors may be supplied with electric power from surface via a wireline or are provided with batteries for the supply of power to the tractor drive arrangement. For example, US 2010/0263856 discloses a battery-driven downhole tractor which is run on a conventional slickline. Alternatively, it is known to supply mechanical power to a downhole tractor from surface. For example, WO 99/24691 discloses a downhole tractor suspended from a wireline which may be electricline, slickline or any other wire or tubular system which is capable of reciprocating movement. The tractor is run into a wellbore until the tractor encounters a deviated section of the wellbore. The tractor is advanced along the deviated section of the wellbore by the repeated application and release of tension in the wireline. Advancing a tractor in this way is a manually intensive time-consuming process which may result in relatively high operating costs.

SUMMARY OF INVENTION

According to a first aspect of the present invention there is provided a system for performing an operation within an elongated space, the system comprising:

a tool configured for deployment within the elongated space;

an insulated slickline connected to the tool;

a winch for hauling in and/or paying out the slickline; and a winch controller which is configured to receive information transmitted electrically from the tool along the slickline and to control the winch according to the received information.

Such a system may permit the winch to be operated according to information provided from the tool. For example, such a system may permit the winch to be operated according to a status of the tool and/or according to a status of an environment surrounding the tool. This may provide greater control of winch operations. This may reduce the time and cost associated with winch operations. This may improve the accuracy and/or reliability of winch operations. This may reduce the time and cost of operations performed within the elongated space. This may improve the accuracy and/or reliability of operations performed within the elongated space.

The winch controller may be configured to control at least one of a direction, speed and torque of the winch according to the information received by the winch controller.

The elongated space may be defined by a tubular member.

The elongated space may be defined within a well.

The elongated space may be defined by or within a wellbore.

The elongated space may be inclined to the vertical or may be horizontal.

The elongated space may form part of a deviated oil or gas well.

In use, the tool may be located in the elongated space and the winch controller may be located outside the elongated space. The winch controller may be located at, adjacent or remote from an opening or an end of the elongated space.

In use, the tool may be located in a wellbore.

In use, the winch controller may be located at or adjacent an opening of the wellbore.

In use, the winch controller may be located at or adjacent a wellhead.

In use, the winch controller may be located at, adjacent or above a surface such as a surface of the ground or a surface of the seabed from which the wellbore extends.

In use, the winch may be located at, adjacent or above a surface such as a surface of the ground or a surface of the seabed from which the wellbore extends.

In use, the winch controller may be located at or adjacent to the winch.

The insulated slickline may comprise a solid electrically conductive core and an electrically insulating outer layer or coating.

The core may comprise a single strand of wire.

The core may comprise a metal.

The core may comprise steel.

The core may comprise an alloy.

The outer layer may comprise an enamel material. For example, the outer layer may comprise polyester, LCP, polyimide, polyamide-imide, polycarbonates, polysulfones, polyester imides, polyether ether ketone, polyurethane, nylon, epoxy, equilibrating resin, alkyd resin, or the like or any combination thereof.

The insulated slickline may have a diameter of up to 6.25 mm.

The insulated slickline may have a diameter between 2.34 mm and 4.17 mm.

The tool may comprise a downhole tool.

The tool may comprise a memory for storing data, for example data measured during logging.

The tool may be configured to perform a mechanical operation.

The tool may be configured to perform an operation on a surface which defines the elongated space.

The tool may be configured to drill, cut, or otherwise remove material from a surface which defines the elongated space.

The tool may be configured to control a flow of fluid in the elongated space.

The tool may be configured to restrict or enhance a flow of fluid in the elongated space.

The tool may be configured to pump a fluid in the elongated space.

The tool may be configured to form a blockage, an occlusion or a seal in the elongated space.

The tool may be configured to actuate a further tool or move an object in the elongated space.

The tool may be configured to move within the elongated space.

The tool may be configured to remain static once deployed within the elongated space. The tool may be configured to selectively engage, grip and/or anchor itself relative to a surface which defines the elongated space.

The tool may be configured to propel a further tool within the elongated space.

The tool may be configured to push and/or pull a further tool along the elongated space.

The tool may comprise a tractor. For example, the tool may comprise a downhole tractor.

The tool may be configured for connection to a further tool.

The tool may be configured for mechanical connection to a further tool.

The tool may be configured for connection into a tool string.

The tool may be configured to receive mechanical power from the winch through the slickline.

The tool may comprise a body member and an actuator member, wherein the actuator member is configured to reciprocate relative to the body member in response to reciprocal motion of the slickline.

The body member may be configured to be anchored relative to a surface defining the elongated space. The body member may comprise one or more gripping members for this purpose.

The tool may be configured to use the mechanical power received from the winch through the slickline to perform an operation within the elongated space.

The tool may be configured to transfer power to a further tool.

The further tool may be configured to use the power received from the tool to perform an operation within the elongated space.

The tool may be configured to convert the mechanical power received from the winch into a different form of power.

The tool may be configured to convert reciprocal motion of the slickline into rotary motion. For example, the tool may comprise a rotatable member which is configured to rotate in response to reciprocal motion of the slickline.

The rotatable member may be mounted on the body member.

The rotatable member may be configured to rotate in response to reciprocal motion of the actuator member relative to the body member.

The tool may comprise a mechanical converter such as a diamond leadscrew type mechanical converter to convert the reciprocal motion of the slickline into rotary motion of the rotatable member. The mechanical converter may be configured to convert the reciprocal motion of the actuator member relative to the body member into rotary motion of the rotatable member.

The tool may be configured to store power.

The tool may be configured to store the mechanical power received from the winch in mechanical form.

The tool may comprise one or more resilient members for storing the mechanical power.

The tool may be configured to convert the mechanical power received from the winch through the slickline into hydraulic power.

The tool may comprise a hydraulic pump, for example a rotary or linear displacement pump.

The hydraulic pump may be driven by reciprocal motion of the actuator member relative to the body member.

The tool may be configured to re-convert the hydraulic power back into mechanical power.

The tool may comprise a hydraulic motor or a hydraulic actuator.

The tool may be configured to store hydraulic power.

The tool may comprise a hydraulic accumulator.

The tool may be configured to convert the mechanical power received from the winch through the slickline into electrical power.

The tool may comprise an electrical generator.

The tool may be configured to re-convert the generated electrical power back into mechanical power.

The tool may comprise a motor.

The tool may be configured to store electrical power.

The tool may comprise an electrical energy storage device.

The tool may comprise a battery.

The tool may comprise one or more tool sensors for sensing a parameter associated with the tool.

The tool may comprise one or more tool sensors for sensing a parameter associated with the slickline adjacent to or in the vicinity of the tool.

The tool may comprise one or more tool sensors for sensing a parameter associated with the elongated space.

The tool may comprise one or more tool sensors for sensing temperature and/or pressure.

The tool may comprise one or more tool sensors for sensing tool configuration.

The tool may comprise one or more tool sensors for sensing the relative position and/or orientation of different tool portions.

The tool may comprise at least one of a linear variable differential transformer, a linear encoder, and a rotary encoder.

The tool may comprise one or more tool sensors for sensing at least one of tool orientation, distance travelled by the tool, tool depth, tool position, tool velocity, tool acceleration.

The tool may comprise one or more gyroscopic sensors and/or accelerometers.

The tool may comprise one or more inertial measurement units.

The tool may comprise one or more tool sensors for sensing slickline tension adjacent to or in the vicinity of the tool.

The winch controller may be configured to control the winch so as to perform a downhole operation.

The winch controller may be configured to control the winch so as to move the tool along the elongated space.

The winch controller may be configured to control the winch according to information relating to the electrical energy stored in the tool and transmitted electrically from the tool along the slickline to the winch controller. For example, the winch controller may be configured to control the winch according to information relating to the electrical energy stored by a tool electrical energy storage device such as a tool battery. The winch controller may be configured to control the winch according to a quantity of electrical energy stored in the tool and/or a rate of consumption of electrical energy stored in the tool.

The winch controller may be configured to control the winch according to information sensed by one or more tool sensors and transmitted electrically from the tool along the slickline to the winch controller.

The winch controller may be configured to control the winch according to a sensed temperature and/or a pressure of the tool and/or the elongated space.

The winch controller may be configured to control the winch according to a sensed configuration of the tool.

The winch controller may be configured to control the winch according to at least one of distance travelled by the tool, tool depth, tool position, tool velocity and tool acceleration.

The winch controller may be configured to control the winch according to a slickline tension sensed adjacent to or in the vicinity of the tool.

The winch controller may be configured to control the winch so as to maintain slickline tension adjacent to or in the vicinity of the tool within a predetermined tension range.

The winch controller may be configured to control the winch so as to maintain slickline tension adjacent to or in the vicinity of the tool above a minimum threshold tension. This may avoid the slickline adjacent to or in the vicinity of the tool becoming slack and tangled. This may avoid the tool becoming tangled in the slickline.

The winch controller may be configured to control the winch so as to maintain slickline tension adjacent to or in the vicinity of the tool below a maximum threshold tension. This may ensure that the slickline adjacent to or in the vicinity of the tool is not exposed to tensions which exceed an elastic limit of the slickline. This may avoid permanent deformation of the slickline. This may avoid weakening, damaging and/or breaking of the slickline.

The tool may comprise a tool controller.

The tool controller may be configured to receive information from the one or more tool sensors.

The tool controller may be configured to process the information received from the one or more tool sensors and to electrically transmit the processed tool sensor information to the winch controller.

The tool controller may be configured to receive information from a tool electrical energy storage device such as a tool battery.

The tool controller may be configured to process the information received from the electrical energy storage device and to electrically transmit the processed electrical energy storage device information to the winch controller.

The information received by the winch controller may comprise electrical storage device status information which includes a quantity of electrical energy stored in the electrical storage device and/or a rate of consumption of the electrical energy stored in the electrical storage device. Since the electrical storage device is not required to provide power for driving the tool, the capacity and size of the electrical storage device may be sufficiently small to avoid the problems associated with conventional battery-driven tools such as conventional battery-driven tractors. Moreover, use of the insulated slickline may allow the communication of electrical storage device status information from the tool controller to the winch controller. For example, the tool controller may communicate the quantity of electrical energy stored in the electrical storage device and/or a rate of consumption of electrical energy stored in the electrical storage device to the winch controller. The winch controller may be configured to operate the winch according to the electrical storage device status information. For example, the winch controller may be configured to curtail or cease further operation of the tool or withdraw the tool from the elongated space altogether according to the electrical storage device status information. Additionally or alternatively, an operator may interface with the winch controller causing it to operate the winch so as to curtail or cease further operation of the tool or so as to withdraw the tool out of the elongated space in response to the electrical storage device status information.

The tool controller may be configured to receive information transmitted electrically from the winch controller along the slickline.

The tool controller may be configured to reconfigure the tool according to the received information. This may allow the tool to respond differently to mechanical power received from the winch via the slickline.

The tool may comprise a first body and a second body, wherein the first and second bodies are configured for reciprocal motion relative to one another.

The first and second bodies may be configured to move alternatingly within the elongated space.

The tool may comprise a resilient compression member acting between the first and second bodies, and an actuator member connected to the slickline, and wherein the first and second bodies and the actuator member are linked so that an increase in tension applied to the slickline urges first and second bodies towards one another so as to compress the resilient compression member therebetween, and a reduction in tension applied to the slickline allows the first and second bodies to be urged apart under the action of the resilient compression member. The first and second bodies and the actuator member may be mechanically or hydraulically linked for this purpose.

The tool may comprise a resilient tension member acting between the first and second bodies, and an actuator member connected to the slickline, and wherein the first and second bodies and the actuator member are linked so that an increase in tension applied to the slickline urges the first and second bodies apart so as to extend the resilient tension member therebetween, and a reduction in tension applied to the slickline allows the first and second bodies to be urged together under the action of the resilient tension member. The first and second bodies and the actuator member may be mechanically or hydraulically linked for this purpose.

The tool may comprise a rack and pinion arrangement, wherein the first and second bodies are mechanically linked by the rack and pinion arrangement.

The rack and pinion arrangement may comprise one or more racks.

The rack and pinion arrangement may comprise one or more pinion wheels.

The first body may comprise one or more pinion wheels

The second body may comprise one or more racks.

The actuator member may comprise one or more racks.

The first body may comprise a first surface-engaging device for engaging a surface defining the elongated space.

The first body may comprise a plurality of first surface-engaging devices for engaging a surface defining the elongated space.

The plurality of first surface-engaging devices may be arranged circumferentially around an outer surface of the first body.

The plurality of first surface-engaging devices may have a uniform circumferential distribution around the outer surface of the first body.

The plurality of first surface-engaging devices may have a non-uniform circumferential distribution around the outer surface of the first body.

The second body may comprise a second surface-engaging device for engaging the surface defining the elongated space.

The second body may comprise a plurality of second surface-engaging device for engaging the surface defining the elongated space.

The plurality of second surface-engaging devices may be arranged circumferentially around an outer surface of the second body.

The plurality of second surface-engaging devices may have a uniform circumferential distribution around the outer surface of the second body.

The plurality of second surface-engaging devices may have a non-uniform circumferential distribution around the outer surface of the second body.

Each of the first and second surface-engaging devices may be selectively engaged with the surface defining the elongated space.

Each of the first and second surface-engaging devices may be biased into engagement with the surface defining the elongated space.

Each of the first and second surface-engaging devices may be selectively disengaged from the surface defining the elongated space.

Each of the first and second surface-engaging devices may be retractable along respective radial directions defined relative to a longitudinal axis of the tool.

The tool may comprise a linear solenoid for each of the first and second surface-engaging devices. Each of the linear solenoids may be operable to retract a corresponding first or second surface-engaging device along a corresponding radial direction defined relative to a longitudinal axis of the tool.

The tool controller may be configured such that, in response to receipt of control information transmitted from the winch controller via the slickline, the tool controller operates each linear solenoid so as to disengage the corresponding first or second surface- surface-engaging device from the surface defining the elongated space.

Each of the first surface-engaging devices may be configured to permit relative motion between the first body and the surface defining the elongated space along a permitted direction.

The tool may be configured to selectively alter the permitted direction of relative motion between the first body and the surface.

Each of the second surface-engaging devices may be configured to permit relative motion between the second body and the surface defining the elongated space along a permitted direction.

The tool may be configured to selectively alter the permitted direction of relative motion between the second body and the surface.

Each of the first and second surface-engaging devices may be configured to roll along a permitted direction relative to the surface defining the elongated space.

Each of the first and second surface-engaging devices may comprise rolling bodies, for example, wheels.

Each of the first and second surface-engaging devices may comprise sprag wheels.

The tool may be configured to reverse the direction along which the first and second surface-engaging devices are permitted to roll relative to the surface defining the elongated space.

Each of the first and second surface-engaging devices may be rotatable around a corresponding axis which axis is aligned along a corresponding radial direction relative to a longitudinal axis of the tool.

The tool may comprise a rotary solenoid for each of the first and second surface-engaging devices. Each rotary solenoid may be operable to rotate a corresponding first or second surface-engaging device relative to a corresponding axis.

The tool controller may be configured such that, in response to receipt of control information transmitted from the winch controller via the slickline, the tool controller operates each rotary solenoid so as to rotate a corresponding first surface-engaging device relative to a corresponding axis. This may reverse the permitted direction of relative motion between the first body and the surface defining the elongated space.

The tool controller may be configured such that, in response to receipt of control information transmitted from the winch controller via the slickline, the tool controller operates each rotary solenoid so as to rotate a corresponding second surface-engaging device relative to a corresponding axis. This may reverse the permitted direction of relative motion between the second body and the surface defining the elongated space.

Each of the first surface-engaging devices may be configured to selectively engage the surface defining the elongated space so as to prevent relative motion between the first body and the surface defining the elongated space. Each of the first surface-engaging devices may be configured to selectively grip the surface defining the elongated space for this purpose.

Each of the second surface-engaging devices may be configured to selectively engage the surface defining the elongated space so as to prevent relative motion between the second body and the surface defining the elongated space. Each of the second surface-engaging devices may be configured to selectively grip the surface defining the elongated space for this purpose.

Each of the first and second surface-engaging devices may comprise clamp shoes, gripping devices, anchor devices, dragblocks and/or the like.

The winch controller may be configured to control the winch so as to move the tool along the elongated space until the tool reaches a predetermined target position within the elongated space. This may provide for the automated operation of the tool and may avoid any requirement for an operator to cyclically operate the winch so as to move the tool along the elongated space.

The winch controller may be programmable with the predetermined target position within the elongated space. The use of the insulated slickline for communications in this way allows the tool to be automatically moved to a predetermined target position in a highly deviated oil and gas well thereby avoiding any requirement for an operator to cyclically operate the winch. The winch controller may be configured to allow an operator to selectively initiate or selectively interrupt tool operation.

The tool may comprise a relative position sensor for sensing the relative positions of at least two of the first and second bodies and the actuator member.

The relative position sensor may be a capacitive or a magnetic displacement sensor.

The relative position sensor may include first and second sensor parts. The first sensor part may be attached to the actuator member. The second sensor part may be attached to the first and/or second body.

The tool controller may be configured for communication with the relative position sensor.

The tool controller may be configured to determine relative position information relating to the relative positions of at least two of the first and second bodies and the actuator member from the information received from the relative position sensor.

The tool controller may be configured to transmit the determined relative position information to the controller via the slickline.

The winch controller may be configured to control the winch in response to the determined relative position information received from the tool controller so as to repeatedly reciprocate the actuator member relative to the first and second bodies. In combination with the action of the resilient compression and/or tension member and the action of the first and second surface-engaging devices, this may result in the tool automatically advancing or inching along the elongated space.

The winch controller may be configured to control the winch so as to reciprocate the actuator member multiple times to advance the tool one step at a time until the tool reaches a predetermined target position within the elongated space.

The electrical storage device may be configured to supply power to the tool controller and/or the relative position sensor.

The tool may comprise cabling which provides an electrical connection from the electrical storage device to the tool controller and/or the relative position sensor.

The cabling may provide an electrical connection from the electrical storage device to the linear solenoids and/or the rotary solenoids.

The cabling may provide an electrical connection from the tool controller to the linear solenoids and/or the rotary solenoids.

The cabling may be arranged so as to avoid restricting relative movement between the actuator member and one or both of the first and second bodies.

The rack and pinion arrangement may be configured to provide an electrical connection between the actuator member and one or both of the first and second bodies. For example, one or more pinion wheels and one or more racks of the rack and pinion arrangement may be electrically conductive for this purpose.

The tool may comprise sliding electrical contacts such as slips or brushes which act between the actuator member and one or both of the first and second bodies so as to provide an electrical contact between the actuator member and one or both of the first and second bodies.

The system may comprise a winch tension sensor for sensing slickline tension adjacent to or in the vicinity of the winch.

The winch controller may be configured to receive information from the winch tension sensor.

The winch controller may be configured to operate the winch according to the information received from the winch tension sensor.

The system may comprise a sensor element for coupling an electrical signal between the core of the slickline and the sensor element.

The sensor element may be electrically connected to the winch controller.

The sensor element may be electrically conductive.

The sensor element may be located in sufficient proximity to the slickline so that a bound electric field extends between an electrically conductive core of the slickline and the sensor element to facilitate the capacitive coupling of a voltage signal between the core of the slickline and the sensor element.

The sensor element may be located in sufficient proximity to the slickline so that a bound magnetic field extends between an electrically conductive core of the slickline and the sensor element to facilitate the inductive coupling of a current signal between the core of the slickline and the sensor element.

The sensor element may at least partially surround the slickline.

The sensor element may be tubular.

The sensor element may be separated from the slickline by a gap. This may permit relative movement between the slickline and the sensor element.

The sensor element may engage the slickline.

The sensor element may engage the electrically insulating outer layer of the slickline.

The sensor element may be configured to roll to permit relative movement between the slickline and the sensor element.

The sensor element may comprise a sheave wheel. In use, the slickline may run around the sheave wheel. The sensor element may engage the electrically conductive core of the slickline.

The sensor element may be configured to allow relative rotation between the insulated slickline and the sensor element about an axis of the slickline.

The sensor element may comprise an electrically conductive slipring element. Such a sensor element may facilitate direct signal connection between the core of the slickline and the winch controller.

The sensor element may be located at one end of the insulated slickline.

The sensor element may be located at, adjacent to, or co-axial with an axle of a drum of the winch.

In use, the sensor element may be located at, adjacent or above a surface such as a surface of the ground or a surface of the seabed. The sensor element may be located within or attached to a wellhead arrangement. The sensor element may be located within a lubricator or a stuffing box of a wellhead arrangement.

One or more of the optional features disclosed in relation to one aspect may apply alone or in any combination in relation to any other aspect.

According to a second aspect of the present invention there is provided a method for use in performing an operation within an elongated space, the method comprising:

connecting a tool to an insulated slickline;

deploying the tool in the elongated space; and controlling a winch to haul in and/or pay out slickline according to information transmitted electrically from the tool along the slickline.

The method may comprise receiving the transmitted information at a winch controller.

The method may comprise using the winch controller to control the winch according to the transmitted information.

The transmitted information may comprise tool status information, for example sensed information relating to at least one of the tool configuration, tension in the slickline adjacent to or in the vicinity of the tool, and the tool environment.

The transmitted information may comprise an indication of the relative positions of at least two parts of the tool.

The transmitted information may comprise status information relating to a tool electrical storage device. For example, the transmitted information may comprise a quantity of electrical energy stored in an electrical storage device of the tool and/or a rate of consumption of the electrical energy stored in the electrical storage device. One or more of the optional features disclosed in relation to one aspect may apply alone or in any combination in relation to any other aspect.

According to a third aspect of the present invention there is provided a tractor system for deploying a tool within an elongated space, the tractor system comprising:

a tractor configured for deployment within an elongated space;

an insulated slickline connected to the tractor;

a winch for hauling in and/or paying out the slickline; and a winch controller which is configured to receive information transmitted electrically from the tractor along the slickline and to control the winch according to the received information.

One or more of the optional features disclosed in relation to one aspect may apply alone or in any combination in relation to any other aspect.

According to a fourth aspect of the present invention there is provided a method for use in deploying a tool within an elongated space, the method comprising:

connecting a tractor to an insulated slickline;

connecting a tool to the tractor;

deploying the tractor and the tool in an elongated space;

controlling a winch to haul in and/or pay out the slickline according to information transmitted electrically from the tractor along the slickline.

The method may comprise receiving the transmitted information at a winch controller.

The method may comprise using the winch controller to control the winch according to the transmitted information.

The transmitted information may comprise tractor status information, for example sensed information relating to at least one of the tractor configuration, tension in the slickline adjacent to or in the vicinity of the tractor, and the tractor environment.

The transmitted information may comprise tractor status information, for example a tractor stroke cycle position. The transmitted information may include an indication of the relative positions of at least two of a first tractor body, a second tractor body and a tractor actuator member.

The transmitted information may comprise electrical storage device status information. For example, the transmitted information may include a quantity of electrical energy stored in an electrical storage device of the tractor and/or a rate of consumption of the electrical energy stored in the electrical storage device. One or more of the optional features disclosed in relation to one aspect may apply alone or in any combination in relation to any other aspect.

BRIEF DESCRIPTION OF THE DRAWINGS

The present invention will now be described by way of non-limiting example only with reference to the following figures of which:

FIG. 3(*b*) shows the downhole tractor of FIG. 2 during advancement of the downhole tractor when the downhole tractor is in an axially compressed configuration during application of tension to the insulated slickline;

FIG. 3(*c*) shows the downhole tractor of FIG. 2 during advancement of the downhole tractor when the downhole tractor is in an axially re-extended configuration after application of tension to the insulated slickline;

FIG. 4(*b*) shows the downhole tractor of FIG. 2 during retrieval of the downhole tractor when the downhole tractor is in an axially compressed configuration during application of tension to the insulated slickline;

FIG. 4(*c*) shows the downhole tractor of FIG. 2 during retrieval of the downhole tractor when the downhole tractor is in an axially re-extended configuration after application of tension to the insulated slickline;

FIG. 5(*b*) shows the alternative downhole tractor of FIG. 5(*a*) during reconfiguration of sprag wheels of the downhole tractor in preparation for retrieval of the alternative downhole tractor;

FIG. 5(*c*) shows the alternative downhole tractor of FIG. 5(*a*) during retrieval of the alternative downhole tractor.

DETAILED DESCRIPTION OF THE DRAWINGS

One skilled in the art will understand that the terms "uphole" and "downhole" are used below for ease of illustration only, but are not intended to be limiting. The term "uphole" refers to a direction along a wellbore towards a point of entry of the wellbore into a surface such as the ground or the seabed, whilst the term "downhole" refers to a direction along the wellbore away from the point of entry. As such, when a wellbore is deviated from the vertical, such terms may refer to directions which differ significantly from a vertical direction and may even refer to horizontal directions. Similarly, the term "proximate" refers to a position closer to the point of entry, and the term "distal" refers to a position further away from the point of entry.

Figure 1:
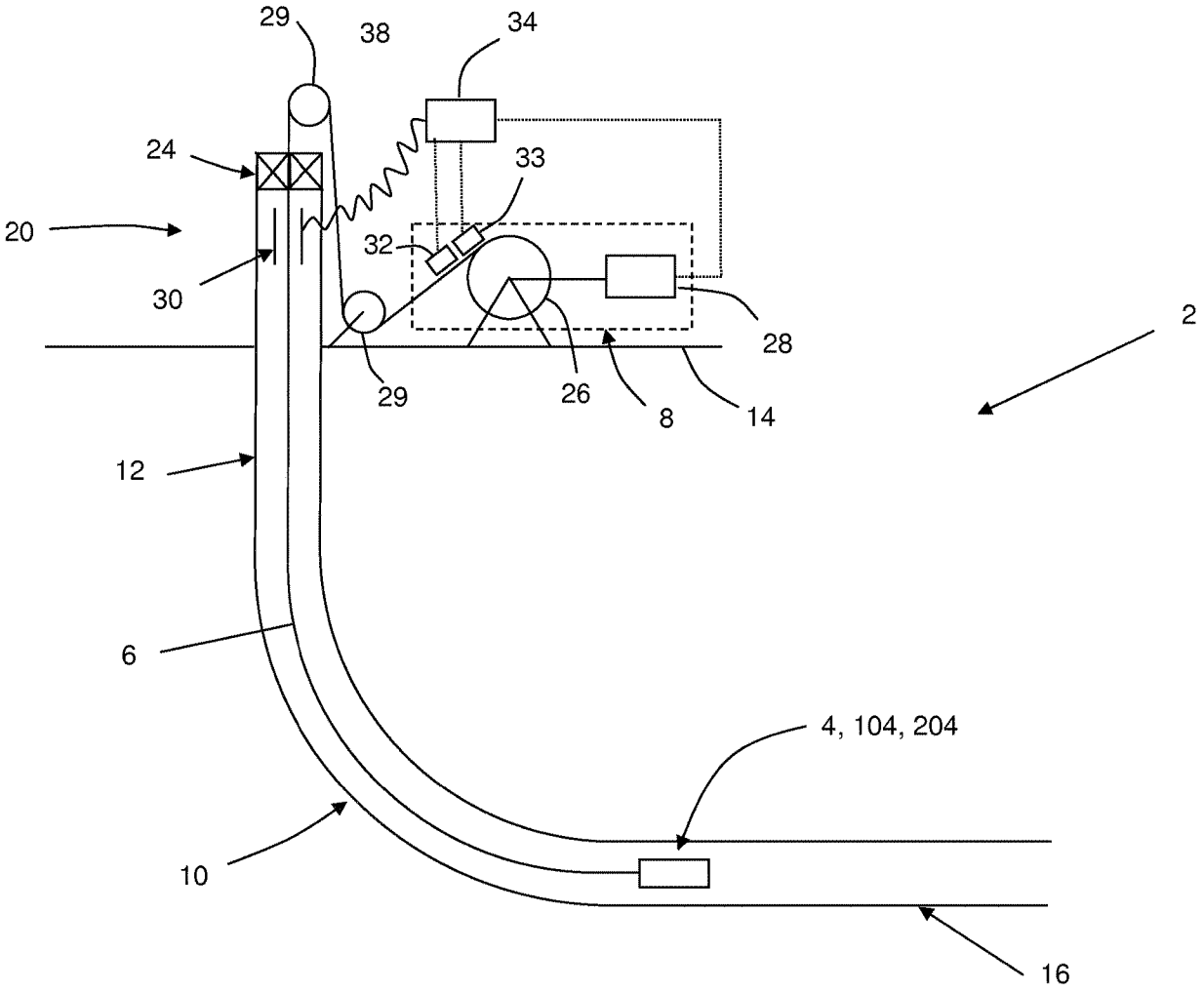
FIG. 1 shows a downhole tool system including a downhole tool and an insulated slickline with the tool located in a wellbore of a deviated oil and gas well.

Referring initially to FIG. 1 there is shown a tool system generally designated 2 including a downhole tool in the form of a tractor generally designated 4 and a slickline 6 connected to the tractor 4. The tool system 2 further includes a winch generally designated 8 for paying out and/or hauling in the slickline 6. The tool system 2 is configured to deploy one or more further downhole tools (not shown in FIG. 1) in a wellbore 10 of a deviated oil and gas well. As shown in FIG. 1, the wellbore 10 may be deviated such that it has a vertical section 12 extending from a surface 14 and a horizontal section 16 extending from a bottom end of the vertical section 12. In use, the tractor 4 is suspended by the slickline and lowered into the vertical section 12 of the wellbore 10 by the winch 8 under the action of gravity until the tractor 4 reaches a position around the beginning of the horizontal section 16 of the wellbore where gravity can no longer act on the tractor 4 to advance it further downhole. The tractor 4 is subsequently operated so as to pull and/or push the one or more downhole tools (not shown) along the horizontal section 16 of the wellbore 10. It should be understood that the wellbore 10 may be lined with a casing or the like along at least part of its length and/or may be an open borehole along at least part of its length.

As shown in FIG. 1, the winch 8 is located above the surface 14 in proximity to a wellhead arrangement 20 mounted at a head of the wellbore 10. It should be understood that the surface 14 may represent ground level or the seabed. It should also be understood that although the winch 8 is shown in FIG. 1 in proximity to the wellhead arrangement 20, the winch 8 may be located remotely from the wellhead arrangement 20.

The wellhead arrangement 20 includes a stuffing box and lubricator arrangement 24 which permits movement of the slickline 6 in and out of the wellbore 10, whilst also sealing the wellbore 10 from an external environment above the surface 14. The winch 8 includes a drum 26 for the slickline 6, a motor 28 for rotating the drum 26 in either direction, a winch tension sensor 32 for sensing tension in the slickline 6 adjacent to or in the vicinity of the winch 8, and a sensor 33 for measuring a length of slickline 6 hauled in and/or paid out by the winch 8 for the determination of a depth of the tool 4 in the wellbore 10. The slickline 6 extends from the drum 26 around sheave wheels 29 and passes through the stuffing box and lubricator arrangement 24 to the tractor 4.

The tool system 2 further includes a tubular electrically conductive sensor element 30 electrically connected to a winch controller 34 by a cable 38. The sensor element 30 mounted around the slickline 6 within the wellhead arrangement 20. Although not shown explicitly in FIG. 1, it should be understood that the slickline 6 includes an inner electrically conductive core surrounded by an outer electrically insulating layer such that, in use, electrical signals may be transmitted from the tractor 4 to surface along the slickline 6. The sensor element 30 is located in sufficient proximity to the outer electrically insulating layer of the slickline 8 so that a bound electric field associated with an electrical signal travelling along an electrically conductive core of the slickline 6 extends and is coupled to the sensor element 30. The winch controller 34 is configured for communication with the motor 28 and the tension sensor 32 of the winch 8.

Figure 2:
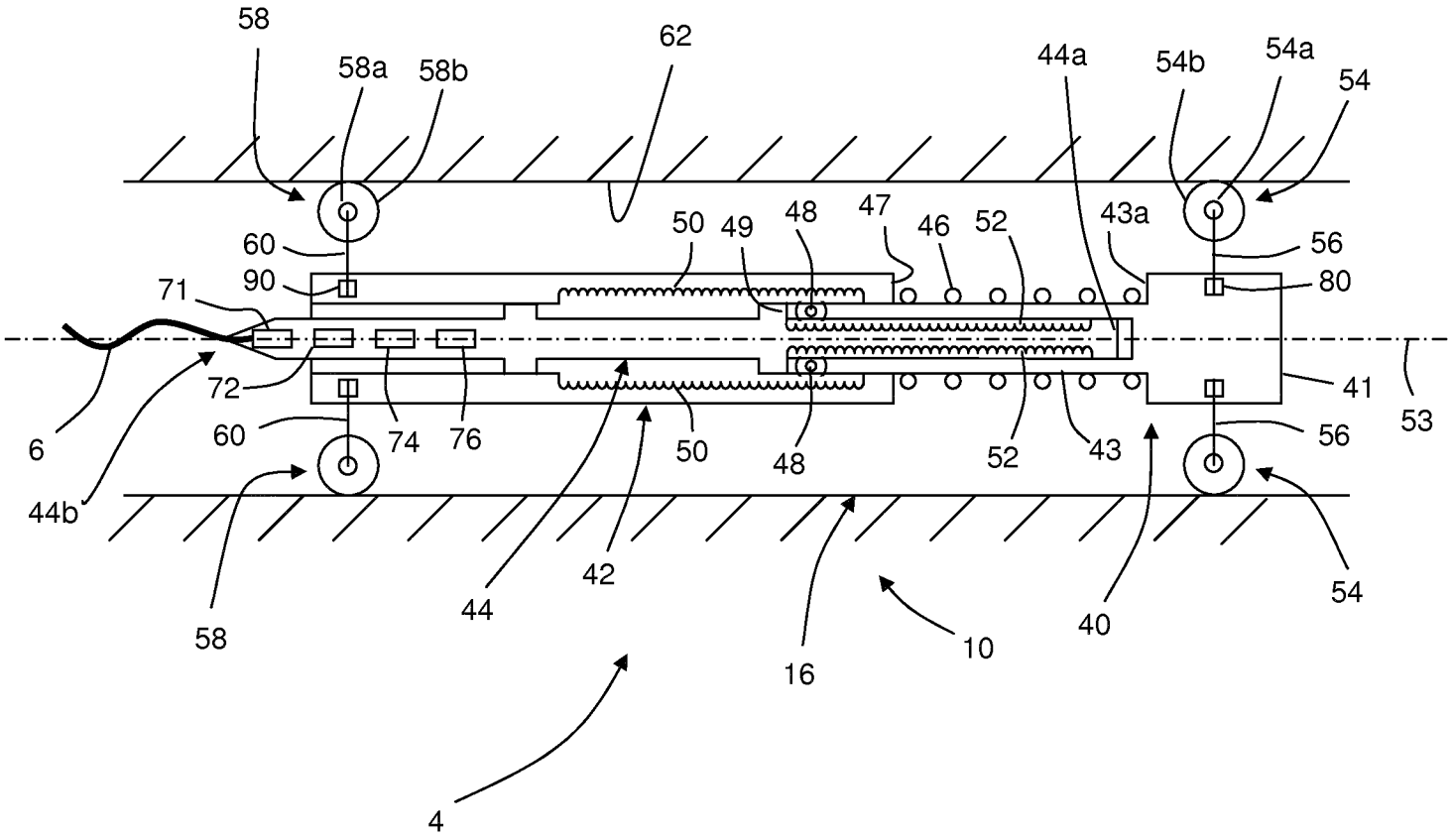
FIG. 2 is a detailed longitudinal cross-section of a downhole tractor for use with the downhole tool system of FIG. 1.

The tractor 4 is shown in greater detail in FIG. 2. The tractor 4 includes a first body in the form of a distal body 40, a generally tubular second body in the form of a proximate body 42, and a generally rod-like actuator member 44 attached at a proximate end 44*b* thereof to the slickline 6. The distal body 40 includes a distal head portion 41 and a proximate tubular portion 43 which together define a shoulder 43*a*. The proximate body 42 receives the proximate tubular portion 43 of the distal body 40. The proximate body 42 defines a distal end 47 which is disposed towards the shoulder 43*a* of the distal body 40.

The actuator member 44 extends through the proximate body 42 into the proximate tubular portion 43 of the distal body 40. A distal end 44*a* of the actuator member 44 is received within the proximate tubular portion 43 of the distal body 40. A resilient compression member in the form of a compression spring 46 is mounted around the tubular proximate portion 43 of the distal body 40 and extends axially between the distal end 47 of the proximate body 42 and the shoulder 43*a* of the distal body 40.

As will be described in more detail below, the distal body 40, the proximate body 42 and the actuator member 44 are mechanically linked so that an increase in tension applied to the slickline 6 urges the distal and proximate bodies 40, 42 towards one another so as to compress the compression spring 46 therebetween, and a reduction in tension applied to the slickline 6 allows the distal and proximate bodies 40, 42 to be urged apart under the action of the compression spring 46 to thereby advance the tractor 4 downhole or uphole.

Pinion wheels 48 are mounted adjacent to a proximate end 49 of the distal body 40. The proximate body 42 defines axially extending racks 50 on an inner surface thereof. The actuator member 44 defines racks 52 which extend axially along an outer surface thereof from the distal end 44*a*. As will be described in more detail below, the pinion wheels 48 engage the racks 50 on the proximate body 42 and the racks 52 on the actuator member 44 such that axial motion of the actuator member 44 relative to the distal body 40 results in relative axial motion between the distal and proximate bodies 40, 42.

The tractor 4 includes distal sprag wheels 54 connected to the distal body 40 by distal wheel support members 56 which extend radially away from the distal body 40 relative to a longitudinal axis 53 of the tractor 4. Similarly, the tractor 4 includes proximate sprag wheels 58 connected to the proximate body 42 by proximate wheel support members 60 which extend radially away from the proximate body 42 relative to the longitudinal axis 53 of the tractor 4. The sprag wheels 54, 58 are biased outwardly into engagement with an inner surface 62 of the wellbore 10. Although only two distal sprag wheels 54 and two proximate sprag wheels 58 (and their respective wheel support members 56, 60) are shown in FIG. 2, it should be understood that the tractor 4 actually includes four distal sprag wheels 54 distributed uniformly around a circumference of the distal body 40 and four proximate sprag wheels 58 distributed uniformly around a circumference of the proximate body 42.

The sprag wheels 54, 58 are configured so as to restrict the direction of rolling of the sprag wheels 54, 58 to a single direction of rolling relative to the inner surface 62 of the wellbore 10. More specifically, each distal sprag wheel 54 includes an inner axle 54*a* which is connected to a wheel support member 56 and an outer sleeve 54*b* which is configured to engage the inner surface 62 of the oil wellbore 10 and which is rotatable relative to the inner axle 54*a* in a single direction. Similarly, each proximate sprag wheel 58 includes an inner axle 58*a* which is connected to a wheel support member 60 and an outer sleeve 58*b* which is configured to engage the inner surface 62 of the wellbore 10 and which is rotatable relative to the inner axle 58*a* in a single direction. Although not shown explicitly in FIG. 2, one skilled in the art will appreciate that each sprag wheel 54, 58 comprises an internal bearing arrangement which includes a plurality of caged sprag elements located between the respective inner axles 54*a*, 58*a* and outer sleeves 54*b*, 58*b*. The sprag elements (not shown) are configured to allow relative rotation of the outer sleeves 54*b*, 58*b* relative to the inner axles 54*a*, 58*a* in a first direction, but to prevent rotation of the outer sleeves 54*b*, 58*b* relative to the inner axles 54*a*, 58*a* in a second direction opposite to the first direction.

The actuator member 44 includes a slickline tension sensor 71 for sensing tension in the slickline 6 adjacent to or in the vicinity of the tractor 4, a tool controller 72, a relative position sensor 74, and a battery 76. The tool controller 72 is electrically connected to the electrically conductive core of the slickline 6 and is configured to transmit an electrical signal to, or receive an electrical signal from, the slickline 6. The tool controller 72 is configured to receive information from the slickline tension sensor 71 and the relative position sensor 74.

The relative position sensor 74 is configured to sense the position of the actuator member 44 relative to the distal and/or proximate bodies 40, 42. For example, the relative position sensor 74 may be configured to detect when the actuator member 44 reaches an end-of-stroke position as discussed in more detail below. The relative position sensor 74 may be a conventional capacitive or magnetic displacement sensor 74 or any other kind of relative position sensor 74. The tool controller 72 is configured to receive a signal from the relative position sensor 74 representative of the position of the actuator member 44 relative to the distal and/or proximate bodies 40, 42 and to determine the relative positions of the distal and proximate bodies 40, 42 from the sensed signal received from the relative position sensor 74. In other words, the tool controller 72 is configured to determine where the tractor 4 is in its stroke cycle from the sensed signal received from the relative position sensor 74 i.e. the tool controller 72 is configured to determine the tractor stroke cycle position.

The battery 76 is electrically connected to the slickline tension sensor 71, the tool controller 72 and the relative position sensor 74 for the provision of electrical power thereto. The tool controller 72 is configured to determine a status of the battery 76 including the quantity of electrical energy stored in the battery 76 and the rate of consumption of the electrical energy stored in the battery 76.

In use, the tractor 4 may be operated so as to advance the tractor 4 and thereby pull and/or push one or more further downhole tools (not shown) connected to the tractor 4 in a downhole direction along the horizontal section 16 of the wellbore 10 as will now be described with reference to FIGS. 3(*a*) to 3(*c*). It should be understood that the sprag wheels 54, 58 are configured so as to permit rolling of the sprag wheels 54, 58 relative to the inner surface 62 of the wellbore 10 in the downhole direction towards the right in FIGS. 3(*a*) to 3(*c*) and so as to prevent rolling of the sprag wheels 54, 58 relative to the inner surface 62 of the wellbore 10 in the uphole direction towards the left in FIGS. 3(*a*) to 3(*c*).

Figure 3:
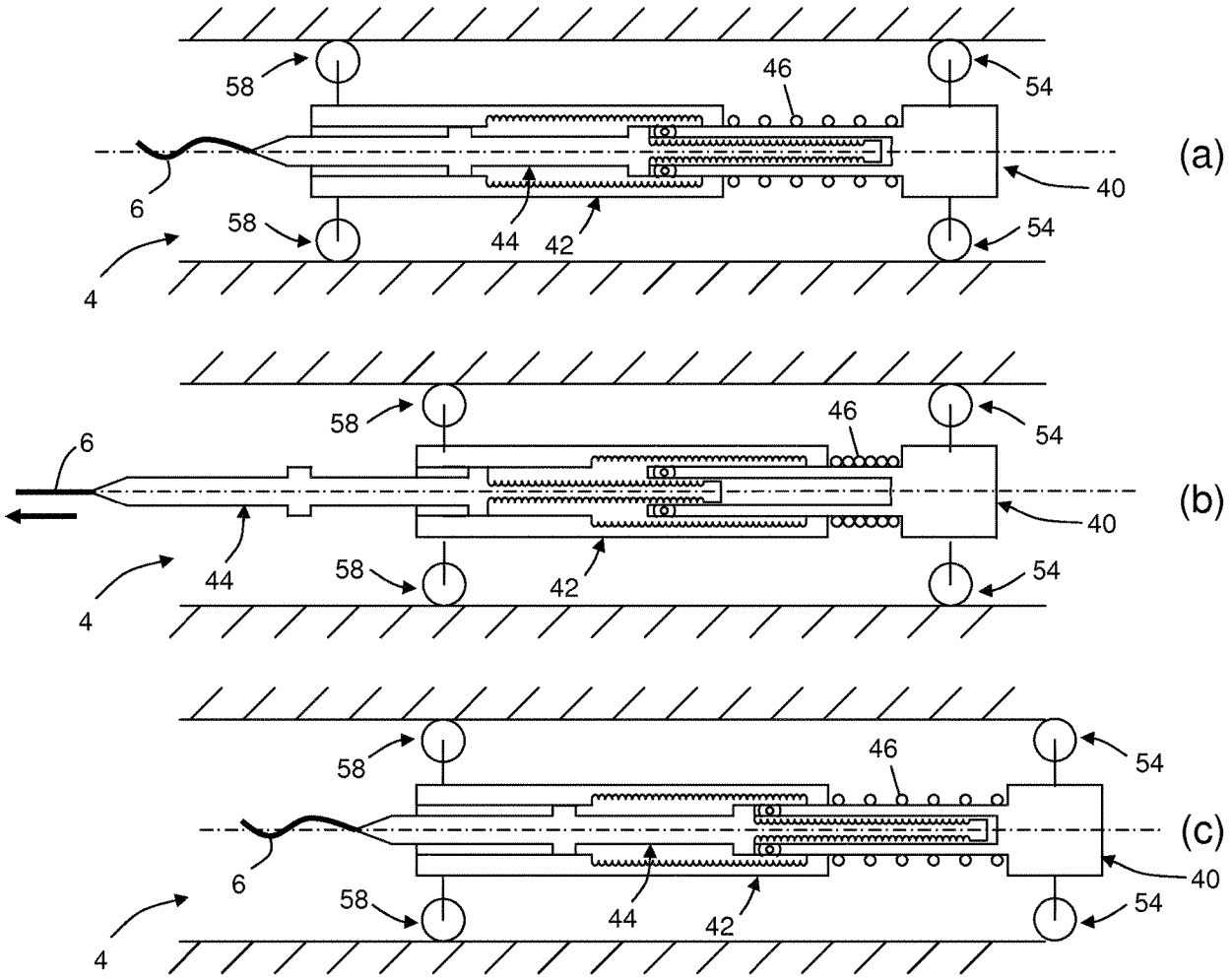
FIG. 3(*a*) shows the downhole tractor of FIG. 2 during advancement of the downhole tractor when the downhole tractor is in an axially extended configuration before application of tension to the insulated slickline.

FIG. 3(*a*) shows the tractor 4 in an initial state when the slickline 6 is slack or under a lower level of tension, the actuator member 44 is in a fully inserted position within the proximate body 42 and the distal body 40, and the compression spring 46 is in its fully extended state. The relative position sensor 74 transmits a signal to the tool controller 72 to indicate that the actuator member 44 has reached its fully inserted position. The tool controller 72 transmits an appropriate electrical signal along the slickline 6 to the winch controller 34 via the sensor element 30 and the cable 38 to indicate that the actuator member 44 has reached its fully inserted position. In response to receipt of the electrical signal, the winch controller 34 operates the motor 28 of the winch 8 so as to apply tension to, or to increase the tension applied to, the slickline 6. The winch controller 34 monitors the tension applied to the slickline via the tension sensor 32 for this purpose. The application of tension to, or the increase in tension applied to the slickline 6, acts to retract the actuator member 44 from within the proximate body 42 and the distal body 40. Since the sprag wheels 54, 58 are configured to prevent rolling of the sprag wheels 54, 58 relative to the inner surface 62 of the wellbore 10 in the uphole direction, the arrangement of the racks 50, 52 and pinion wheels 48 serves to advance the proximate body 42 towards the distal body 40 thereby compressing the compression spring 46 between the proximate body 42 and the distal body 40.

When the actuator member 44 reaches its fully retracted position shown in FIG. 3(*b*), the compression spring 46 is in its fully compressed state. The relative position sensor 74 transmits a signal to the tool controller 72 to indicate that the actuator member 44 has reached its fully retracted position. The tool controller 72 transmits an appropriate electrical signal along the slickline 6 to the winch controller 34 via the sensor element 30 and the cable 38 to indicate that the actuator member 44 has reached its fully retracted position. In response to receipt of the electrical signal, the winch controller 34 operates the motor 28 of the winch 8 so as to reduce tension in the slickline 6. The winch controller 34 monitors the tension applied to the slickline via the tension sensor 32 for this purpose. Since the sprag wheels 54, 58 are configured to prevent rolling of the sprag wheels 54, 58 relative to the inner surface 62 of the wellbore 10 in the uphole direction, the reduction of tension in the slickline 6 allows the compression spring 46 to drive the distal body 40 in the downhole direction and the arrangement of the racks 50, 52 and pinion wheels 48 serves to re-insert the actuator member 44 within the proximate body 42 and the proximate tubular portion 43 of the distal body 40 until the compression spring 46 reaches its fully extended position and the actuator member 44 is in its fully inserted position once again as shown in FIG. 3(*c*). The sequence of movements of the distal body 40, the proximate body 42 and the actuator member 44 depicted in FIGS. 3(*a*) to 3(*c*) results in movement of the tractor 4 by one "step" along the wellbore 10 in the downhole direction. The sequence of movements of the distal body 40, the proximate body 42 and the actuator member 44 depicted in FIGS. 3(*a*) to 3(*c*) is automatically repeated multiple times under the control of the winch controller 34 and the tool controller 72 to advance the tractor 4 one step at a time in the downhole direction until the tractor 4 reaches a predetermined target position within the horizontal section 16 of the wellbore 10. The use of the insulated slickline 6 for communication of tractor stroke cycle position information in this way allows the tractor 4 to be automatically advanced downhole to a predetermined target position in a highly deviated oil and gas well thereby avoiding any requirement for an operator to cyclically operate the winch 8.

Since the battery 76 is not required to provide power for driving the tractor 4, the battery capacity and size problems associated with conventional battery-driven tractors may be avoided. Moreover, use of the insulated slickline 6 may allow the communication of battery status information associated with the battery 76 from the tool controller 72 of the tractor 4 to the winch controller 34. For example, the tool controller 72 may communicate the quantity of electrical energy stored in the battery 76 and/or a rate of consumption of electrical energy stored in the battery 76 to the winch controller 34. The winch controller 34 may be configured to operate the winch 8 according to the battery status information. For example, the winch controller 34 may be configured to curtail or cease further operation of the winch 8 or to control the winch 8 so as to pull the tractor 4 out of the wellbore 10 according to the battery status information. Additionally or alternatively, an operator may interface with the winch controller 34 causing it to operate the winch 8 so as to curtail or cease further operation of the tractor 4 or so as to pull the tractor 4 out of the wellbore 10 in response to the battery status information.

In addition, use of the insulated slickline 6 may allow the communication of slickline tension sensed by the tool slickline tension sensor 71 from the tool controller 72 of the tractor 4 to the winch controller 34. The winch controller 34 may be configured to operate the winch 8 according to the sensed tension in the slickline 6 adjacent to or in the vicinity of the tractor 4. For example, the winch controller 34 may be configured to curtail or cease further operation of the winch 8 or to control the winch 8 so as to pull the tractor 4 out of the wellbore 10 according to the sensed tension in the slickline 6 adjacent to or in the vicinity of the tractor 4. Additionally or alternatively, an operator may interface with the winch controller 34 causing it to operate the winch 8 so as to curtail or cease further operation of the tractor 4 or so as to pull the tractor 4 out of the wellbore 10 in response to the sensed tension in the slickline 6 adjacent to or in the vicinity of the tractor 4.

With reference to FIG. 2 once again, the distal body 40 further includes rotary solenoids 80 which are operable to rotate respective wheel support members 56 through 180° about respective radially aligned axes. Similarly, the proximate body 42 includes rotary solenoids 90 which are operable to rotate respective wheel support members 60 through 180° about respective radially aligned axes. The rotary solenoids 80, 90 are electrically connected to the tool controller 72 and to the battery 76 via cabling (not shown) between the actuator member 44 and the distal body 40 and between the actuator member 44 and the proximate body 42. The cabling (not shown) is arranged so as to avoid restricting the relative movements between the actuator member 44 and the distal body 40 and between the actuator member 44 and the proximate body 42 described above with reference to FIGS. 3(*a*) to 3(*c*). As described in more detail below, the tool controller 72 controls the operation of the rotary solenoids 80, 90 via the cabling (not shown) whilst the battery 76 provides power to the rotary solenoids 80, 90 via the cabling (not shown).

When it is desirable to pull the tractor 4 out of the wellbore 10, an operator may interface with the winch controller 34 causing it to transmit an appropriate electrical signal along the slickline 6 to the tool controller 72. The tool controller 72 operates the rotary solenoids 80 and 90 so as to rotate the wheel support members 56 and 60 through 180° about respective radially aligned axes. In effect, this reverses the direction in which the proximate and distal sprag wheels 54, 58 are permitted to roll so that the winch 8 may pull the tractor 4 in the uphole direction via the slickline 6 under the control of an operator.

Figure 4:
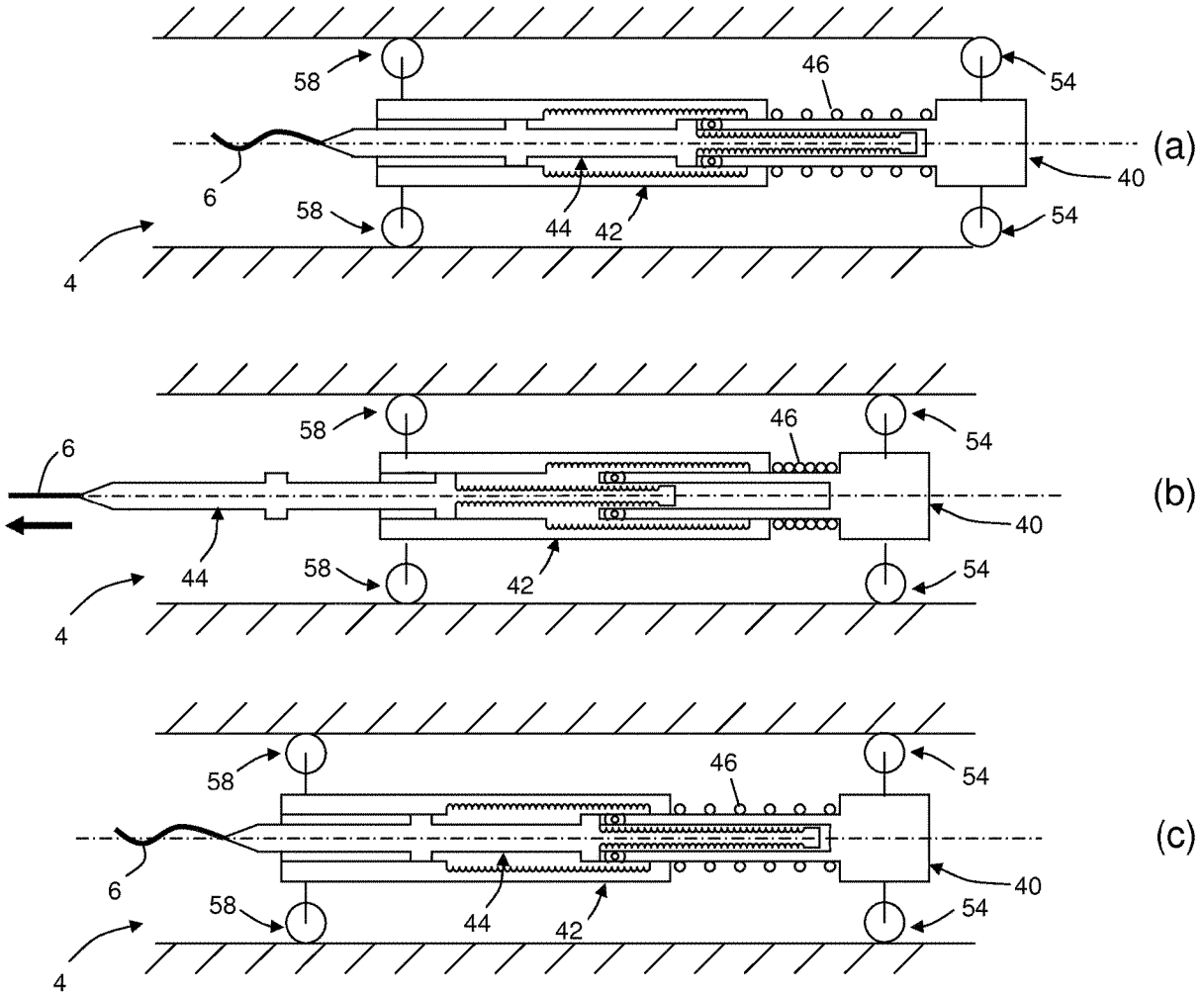
FIG. 4(*a*) shows the downhole tractor of FIG. 2 during retrieval of the downhole tractor when the downhole tractor is in an axially extended configuration before application of tension to the insulated slickline.

If desirable, the tractor 4 may be advanced in the uphole direction within the horizontal section 16 of the wellbore 10 using the process shown in FIGS. 4(*a*) to 4(*c*). As will be apparent to one skilled in the art, the process shown in FIGS. 4(*a*) to 4(*c*) is effectively the reverse of the process used to advance the tractor 4 in the downhole direction as described with reference to FIGS. 3(*a*) to 3(*c*). Initially, as shown in FIG. 4(*a*), the actuator member 44 is fully inserted within the distal body 40 and the compression spring 46 is in an extended configuration. On application of tension to the slickline 6 as shown in FIG. 4(*b*), the actuator member 44 is retracted in the uphole direction. Since the sprag wheels 54, 58 are now configured to prevent rolling of the sprag wheels 54, 58 relative to the inner surface 62 of the wellbore 10 in the downhole direction, the arrangement of the racks 50, 52 and pinion wheels 48 serves to advance the distal body 40 in the uphole direction towards the proximate body 42 thereby compressing the compression spring 46 between the distal body 40 and the proximate body 42. Release or reduction of the tension in the slickline 6 permits the compression spring 46 to drive the proximate body 42 away from the distal body 40 in the uphole direction as shown in FIG. 4(*c*). The sequence of movements of the distal body 40, the proximate body 42 and the actuator member 44 depicted in FIGS. 4(*a*) to 4(*c*) is automatically repeated multiple times under the control of the winch controller 34 and the tool controller 72 to advance the tractor 4 one step at a time in the uphole direction until the tractor 4 reaches a predetermined target position within the horizontal section 16 of the wellbore 10.

Figure 5:
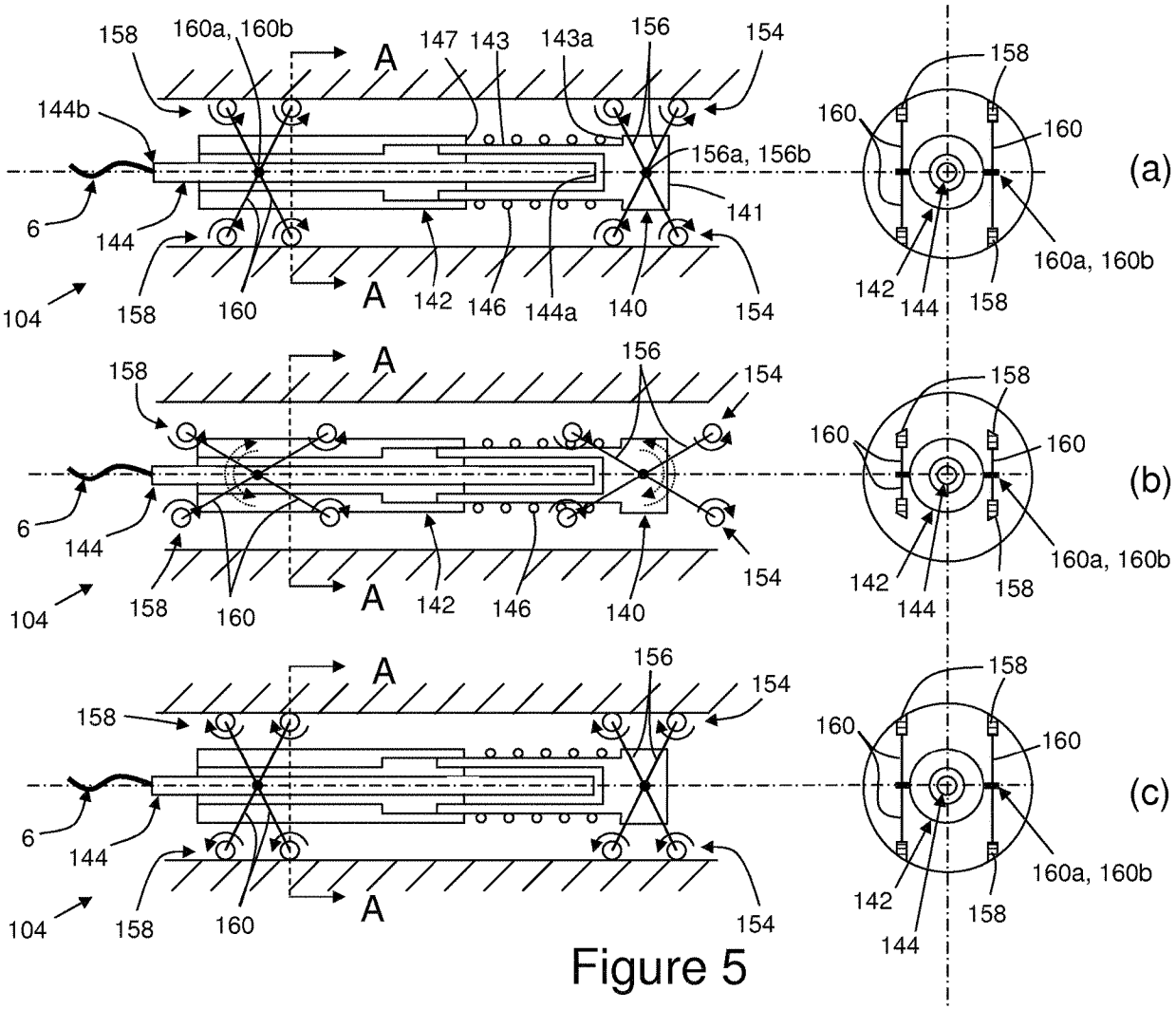
FIG. 5(*a*) shows a longitudinal cross-section of an alternative downhole tractor during advancement of the downhole tractor.

An alternative downhole tractor 104 for use with the downhole tool system 2 of FIG. 1 is shown in FIG. 5(*a*) during advancement of the downhole tractor 104 in the downhole direction shown to the right in FIG. 5(*a*). The downhole tractor 104 shares many features with the downhole tractor 4 described with reference to FIGS. 2 to 4(*c*) and, as such, like features of the downhole tractor 104 have identical reference numerals to like features of the downhole tractor 4 but incremented by "100". In particular, downhole tractor 104 comprises a distal body 140, a generally tubular proximate body 142 and a generally rod-like actuator member 144 attached at a proximate end 144*b* thereof to a slickline 6. The distal body 140 includes a distal head portion 141 and a proximate tubular portion 143 which together define a shoulder 143*a*. The proximate body 142 receives the proximate tubular portion 143 of the distal body 140. The proximate body 142 defines a distal end 147 which is disposed towards the shoulder 143*a* of the distal body 140.

The actuator member 144 extends through the proximate body 142 into the proximate tubular portion 143 of the distal body 140. A distal end 144*a* of the actuator member 144 is received within the proximate tubular portion 143 of the distal body 140. A resilient compression member in the form of a compression spring 146 is mounted around the tubular proximate portion 143 of the distal body 140 and extends axially between the distal end 147 of the proximate body 142 and the shoulder 143*a* of the distal body 40.

The distal body 140, the proximate body 142 and the actuator member 144 are mechanically linked by a rack and pinion arrangement (not shown) identical to that of the downhole tractor 4 described with reference to FIGS. 2 to 4(*c*). An increase in tension applied to the slickline 6 urges the distal and proximate bodies 140, 142 towards one another so as to compress the compression spring 146 therebetween, and a reduction in tension applied to the slickline 6 allows the distal and proximate bodies 140, 142 to be urged apart under the action of the compression spring 146 to thereby advance the tractor 104 downhole or uphole.

Unlike the downhole tractor 4 of FIGS. 2 to 4(*c*), downhole tractor 104 comprises eight distal spragwheels 154 mounted on four distal wheel support members 156 and eight proximate sprag wheels 158 mounted on four proximate wheel support members 160. Each distal wheel support member 156 is pivotable about a corresponding wheel support member pivot axle 156*a* under the action of a corresponding rotary solenoid 156*b*. Similarly, each proximate wheel support member 160 is pivotable about a corresponding wheel support member pivot axle 160*a* under the action of a corresponding rotary solenoid 160*b*. The distal and proximate spragwheels 154, 158 are biased into engagement with the inner surface 62 of the wellbore 10. For example, the distal and proximate wheel support members 156, 160 may have linear compression springs (not shown) mounted thereon for this purpose. Additionally or alternatively, the distal and proximate wheel support members 156, 160 may be biased by respective hinge spring arrangements (not shown) acting at the corresponding wheel support member pivot axles 156*a*, 160*a* so as to bias the distal and proximate spragwheels 154, 158 into engagement with the inner surface 62 of the wellbore 10.

During advancement of the downhole tractor 104 in a downhole direction shown to the right in FIG. 5(*a*), the spragwheels 154, 158 are oriented so as to permit rolling of the spragwheels 154, 158 relative to the inner surface 62 of the wellbore 10 for downhole movement of the downhole tractor 104. For example, to permit movement of the downhole tractor 4 in the downhole direction shown to the right in FIG. 5(*a*), the spragwheels 154, 158 in the upper half of FIG. 5(*a*) are configured to rotate in an anti-clockwise direction and the spragwheels 154, 158 in the lower half of the FIG. 5(*a*) are configured to rotate in a clockwise direction.

When the downhole tractor 104 is to be retrieved from the wellbore 10, the operator interfaces with the winch controller 34 causing it to transmit an appropriate electrical signal to a tool controller (not shown) located within the downhole tractor 104 via the slickline 6. The tool controller subsequently controls the rotary solenoids 156*b* and 160*b* causing the wheel support members 156, 160 to pivot about their corresponding pivot axles 156*a*, 160*a*, as shown in FIG. 5(*b*) until the sprag wheels 154, 158 engage an opposite side of the inner surface 62 of the wellbore 10 as shown in FIG. 5(*c*). The spragwheels 154, 158 are now oriented so as to permit rolling of the spragwheels 154, 158 relative to the inner surface 62 of the wellbore 10 for uphole movement of the downhole tractor 104 i.e. the spragwheels 154, 158 in the upper half of FIG. 5(*c*) are configured to rotate in a clockwise direction and the spragwheels 154, 158 in the lower half of the FIG. 5(*c*) are configured to rotate in an anti-clockwise direction.

One skilled in the art will appreciate that various modifications of the tractor 4 may be made without departing from the scope of the present invention. For example, with reference to FIG. 2, as an alternative, or in addition, to using rotary solenoids 80, 90 to rotate the wheel support members 56, 60, linear solenoids may be used to retract wheel support members 56 radially towards the distal body 40 and to retract wheel support members 60 radially towards the proximate body 42. When it is desirable to advance the tractor 4 in the uphole direction, an operator interfaces with the winch controller 34 causing it to transmit an appropriate electrical signal along the slickline 6 to the tool controller 72. The tool controller 72 operates the linear solenoids to radially retract the wheel support members 56 and 60. In effect, this disengages the distal and proximate sprag wheels 54, 58 from the inner surface 62 of the wellbore 10 thereby allowing the winch 8 to pull the tractor 4 in the uphole direction via the slickline 6 under the control of an operator.

Although the relative position sensor 74 is shown as being attached to the actuator member 44 in FIG. 2, one skilled in the art will appreciate that the relative position sensor 74 may include first and second parts, wherein the first part is attached to the actuator member 44 and the second part is attached to the distal body 40 or the proximate body 42. The relative position sensor 74 may be configured to communicate the relative positions of the first and second parts to the tool controller 72.

The rotary solenoids 80, 90 may be electrically connected to the tool controller 72 and to the battery 76 via the pinion wheels 48 and the racks 50, 52. The pinion wheels 48 and the racks 50, 52 may be electrically conductive for this purpose.

The rotary solenoids 80, 90 may be electrically connected to the tool controller 72 and to the battery 76 via sliding electrical contacts such as slips or brushes (not shown)

which act between the actuator member 44 and the distal body 40 and between the actuator member 44 and the proximate body 42.

The distal and proximate bodies 40, 42 may each include a sub-controller configured for wireless communication with the tool controller 72. Each sub-controller may be configured to wirelessly receive command signals from the tool controller 72 and to control the operation of the corresponding rotary solenoids 80, 90 in response to the received command signals. Inductive coupling may be used between the actuator member 44 and the distal body 40 and between the actuator member 44 and the proximate body 42 for the supply of power from the battery 76 to each sub-controller. The distal and proximate bodies 40, 42 may each include a local battery for the supply of power to the corresponding rotary solenoids 80, 90. Each sub-controller may be capable of wirelessly transmitting battery status information from the corresponding local battery to the tool controller 72.

Figure 6:
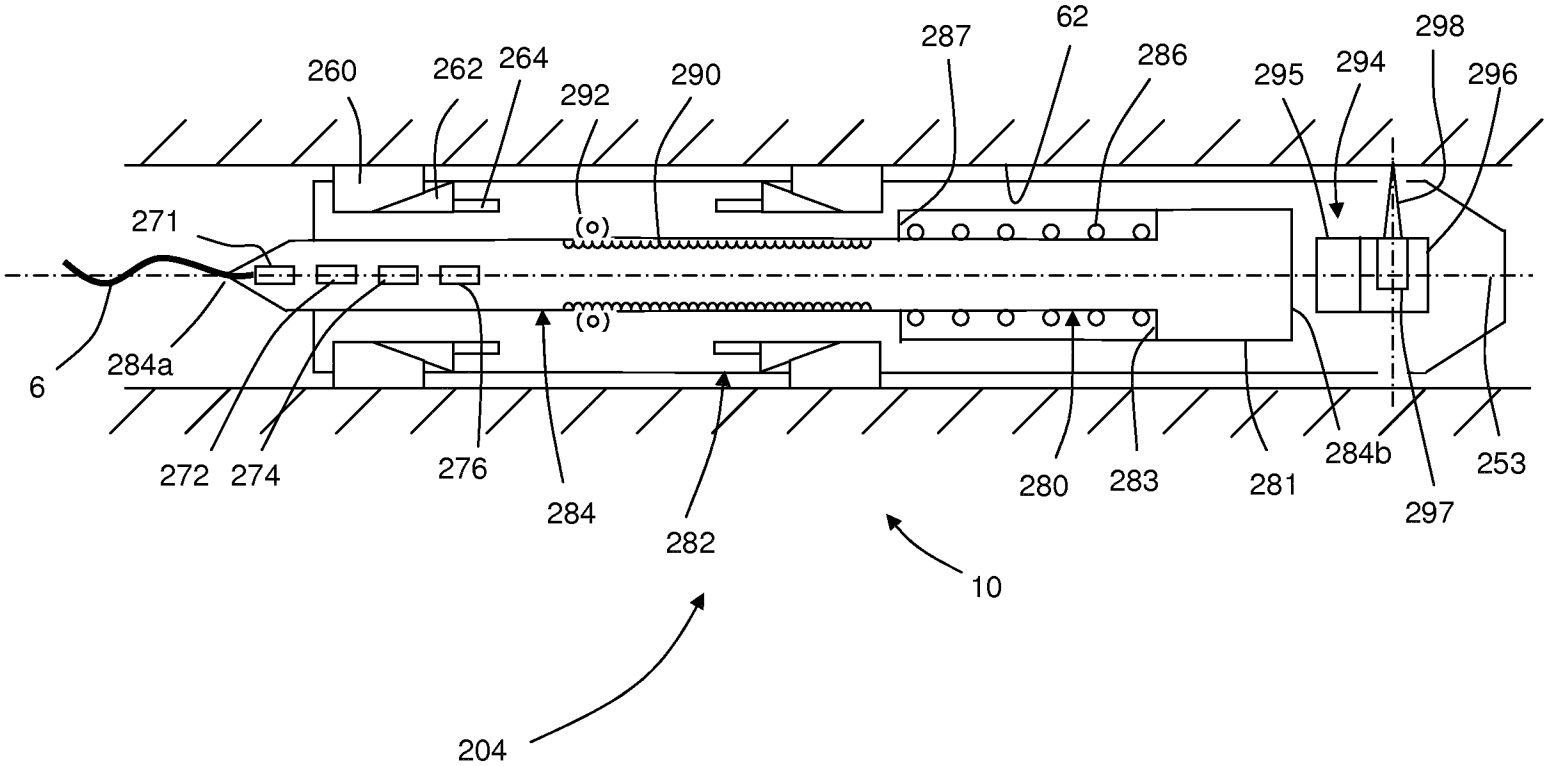
FIG. 6 shows a longitudinal cross-section of a downhole generator tool and a downhole cutting tool for use with the downhole tool system of FIG. 1.

An alternative tool for use with the tool system 2 of FIG. 1 is shown in FIG. 6. The alternative tool takes the form of a downhole generator tool generally designated 204 which is configured to generate electrical power for driving a downhole cutting tool generally designated 294. The downhole generator tool 204 comprises a generally tubular body member 282 and an actuator member 284 which is configured to reciprocate within the body member 282 along an axis 253 of the body member 282. It should be understood that, although the downhole generator tool 204 and the downhole cutting tool 294 are shown housed within the body member 282 in FIG. 6, the downhole cutting tool 294 may be housed separately from the downhole generator tool 204. In either case, the downhole generator tool 204 is electrically connected to the downhole cutting tool 294 via a cable or the like (not shown) for the provision of electrical power thereto. Where the downhole cutting tool 294 is housed separately from the downhole generator tool 204, the downhole cutting tool 294 and the downhole generator tool 204 may also be mechanically coupled.

A proximate end 284*a* of the actuator member 284 is attached to the slickline 6. The actuator member 284 comprises a shaft portion generally designated 280 which extends from the proximate end 284*a* of the actuator member 284 to a head portion 281 of the actuator member 284 located at a distal end 284*b* of the actuator member 284. The shaft portion 280 of the actuator member 284 and the head portion 281 of the actuator member 284 together define a shoulder 283. A resilient member in the form of a compression spring 286 extends around the shaft portion 280 of the actuator member 284 axially between the shoulder 283 of the actuator member 284 and a shoulder 287 of the body member 282.

One or more racks 290 are defined on an outer surface of the shaft portion 280 of the actuator member 284. The body member 282 comprises a plurality of pinions 292 extending from an inner surface thereof. The pinions 292 engage the one or more racks 290 such that reciprocal motion of the actuator member 284 within the body member 282 results in rotation of the pinions 292. The pinions 292 are mechanically coupled to one or more electrical generators (not shown). The one or more electrical generators (not shown) are connected by a cable or the like (not shown) to the downhole cutting tool 294 for the provision of power thereto. Additionally or alternatively, the one or more electrical generators (not shown) may be connected by a cable or the like (not shown) to an electrical storage device such as a battery (not shown) for the storage of electrical power. The electrical storage device may provide electrical power to the downhole cutting tool 294 on demand.

The body member 282 comprises a plurality of gripping members 260, a corresponding plurality of wedges 262 and a corresponding plurality of actuators 264. Each actuator 264 is operable to move a corresponding wedge 262 axially and thereby extend the gripping members 260 radially outwards into engagement with a surface 62 of the wellbore 10 so as to prevent relative axial motion between the body member 282 and the surface 62.

Like the downhole tractor 4, the downhole generator tool 204 comprises a slickline tension sensor 271, a tool controller 272, a relative position sensor 274 and a battery 276. The battery 276 is electrically connected to the slickline tension sensor 271, the tool controller 272 and the relative position sensor 274 for the provision of electrical power thereto. In addition, the battery 276 may be electrically connected to each of the actuators 264 for the provision of electrical power thereto.

The downhole cutting tool 294 comprises an electrical motor 295 which is configured to rotate a shaft 296, and a cutting blade 298 which is retractably mounted on the shaft 296. The downhole cutting tool 294 comprises an actuator 297 housed within the shaft 296 for radially extending the cutting blade 298 into engagement with the inner surface 62 of the wellbore 10. The inner surface 62 of the wellbore 10 may, for example, comprise the inner surface of a wellbore tubular which is to be cut by the downhole cutting tool 294.

In use, the downhole generator tool 204 is run into the wellbore 10 on the slickline 6. When the downhole generator tool 204 reaches a desired location within the wellbore 10, the winch controller 34 communicates with the tool controller 272 which operates the actuators 264 so as to extend the gripping members 260 into engagement with the surface 62. Similarly, the winch controller 34 communicates with the tool controller 272 which operates the actuator 297 of the downhole cutting tool 294 so as to extend the cutting blade 298 into engagement with the surface 62.

The winch controller 34 controls the winch 8 to apply tension to the slickline 6 thereby causing the actuator member 284 to move upwardly (to the left in FIG. 6) within the body member 282 so as to rotate the pinions 292 in a first direction and compress the compression spring 286. Rotation of the pinions 292 in the first direction drives the one or more electrical generators (not shown) for the generation of electrical power. Subsequently, the winch controller 34 controls the winch 8 to pay out the slickline 6 to permit the compression spring 286 to expand thereby causing the actuator member 284 to move downwardly (to the right in FIG. 6) under the action of the compression spring 286 within the body member 282 and to rotate the pinions 292 in a second direction opposite to the first direction. Rotation of the pinions 292 in the second direction drives the one or more electrical generators (not shown) for the generation of electrical power. When the actuator member 284 reaches the end of its stroke as sensed by the relative position sensor 274, the tool controller 272 communicates this information to the winch controller 34 via the slickline 6. In response to receipt of this information, the winch controller 34 controls the winch 8 to re-apply tension to the slickline 6 once again. The actuator member 284 may be repeatedly reciprocated in this way under the action of the winch controller 34 so as to generate electrical power for driving the motor 295 of the downhole cutting tool 294.

One skilled in the art will appreciate that various modifications of the downhole generator tool 204 may be made without departing from the scope of the present invention.

For example, the downhole generator tool 204 may comprise a mechanical converter such as a diamond leadscrew type mechanical converter to convert the relative reciprocal motion of the actuator member 284 and the body member 282 into rotary motion of a rotatable member. The downhole generator tool 204 may be configured to convert the mechanical power received from the winch 8 through the slickline 6 into hydraulic power. The downhole generator tool 204 may comprise a hydraulic pump, for example a rotary or linear displacement pump, for this purpose. The hydraulic pump may be driven by reciprocal motion of the actuator member 284 relative to the body member 282. The downhole generator tool 204 may be configured to re-convert the hydraulic power back into mechanical power. The downhole generator tool 204 may comprise a hydraulic motor or a hydraulic actuator. The downhole generator tool 204 may be configured to store hydraulic power. The downhole generator tool 204 may comprise a hydraulic accumulator.

What is claimed is:

1. A system for performing an operation within an elongated space, the system comprising:

a tool configured for deployment within the elongated space;

an insulated slickline connected to the tool;

a winch for hauling in and/or paying out the slickline; and a winch controller which is configured to receive information transmitted electrically from the tool along the slickline and to control the winch according to the received information, wherein the insulated slickline comprises a solid electrically conductive core and an electrically insulating outer layer or coating, the core comprising a single strand of wire, and wherein the tool is configured to receive mechanical power from the winch through the slickline and to store energy derived from the received mechanical power, the stored energy comprising at least one of mechanical energy, hydraulic energy and electrical energy.

2. A method for use in performing an operation within an elongated space, comprising:

connecting a tool to an insulated slickline;

deploying the tool in the elongated space; and controlling a winch to haul in and/or pay out slickline according to information transmitted electrically from the tool along the slickline, wherein the insulated slickline comprises a solid electrically conductive core and an electrically insulating outer layer or coating, the core comprising a single strand of wire, and wherein the tool receives mechanical power from the winch through the slickline and stores energy derived from the received mechanical power, the stored energy comprising at least one of mechanical energy, hydraulic energy and electrical energy.

3. A system according to claim 1, wherein the winch controller is configured to control at least one of a direction, speed and torque of the winch according to the information received by the winch controller.

4. A system according to claim 1, wherein the elongated space is defined by, or within, a wellbore.

5. A system according to claim 1, wherein the tool is configured to perform an operation on a surface which defines the elongated space or wherein the tool is configured to drill, cut, or otherwise remove material from a surface which defines the elongated space.

6. A system according to claim 1, wherein the tool is configured to selectively engage, grip, or anchor itself relative to a surface which defines the elongated space.

7. A system according to claim 1, wherein the tool is configured to control a flow of fluid in the elongated space, wherein the tool is configured to restrict or enhance a flow of fluid in the elongated space, wherein the tool is configured to pump a fluid in the elongated space, or wherein the tool is configured to form a blockage, an occlusion or a seal in the elongated space.

8. A system according to claim 1, wherein the tool is configured to convert mechanical power received from the winch through the slickline into a different form of power.

9. A system according to claim 8, wherein the tool comprises a rotatable member and the tool is configured to convert reciprocal motion of the slickline into rotary motion of the rotatable member.

10. A system according to claim 8, wherein the tool is configured to convert the mechanical power received from the winch through the slickline into electrical and/or hydraulic power and to re-convert the electrical or hydraulic power back into mechanical power.

11. A system according to claim 1, wherein the tool comprises an energy storage device.

12. A system according to claim 11, wherein the energy storage device comprises an electrical energy storage device or wherein the energy storage device comprises a battery.

13. A system according to claim 11, wherein the energy storage device comprises a hydraulic energy storage device.

14. A system according to claim 1, wherein the tool comprises one or more tool sensors for sensing a parameter associated with at least one of the tool, a parameter associated with the slickline adjacent to or in the vicinity of the tool, and a parameter associated with the elongated space.

15. A system according to claim 14, wherein the one or more tool sensors comprise at least one of a linear variable differential transformer, a linear encoder, and a rotary encoder.

16. A system according to claim 1, wherein the tool comprises a tool controller which is configured to receive information from a tool electrical energy storage device and/or from one or more tool sensors, to process the received information, and to electrically transmit the processed information to the winch controller.

17. A system according to claim 16, wherein the tool controller is configured to receive information transmitted electrically from the winch controller along the slickline and to reconfigure the tool according to the received information.

18. A system according to claim 1, wherein the tool comprises a first body and a second body, and the first and second bodies are configured for reciprocal motion relative to one another.

19. A system according to claim 18, wherein the tool comprises a resilient compression member acting between the first and second bodies, and an actuator member connected to the slickline, and wherein the first and second bodies and the actuator member are linked so that an increase in tension applied to the slickline urges first and second bodies towards one another so as to compress the resilient compression member therebetween, and a reduction in tension applied to the slickline allows the first and second bodies to be urged apart under the action of the resilient compression member.

20. A system according to claim 18, wherein the tool comprises a resilient tension member acting between the first and second bodies, and an actuator member connected to the slickline, and wherein the first and second bodies and the actuator member are linked so that an increase in tension applied to the slickline urges the first and second bodies apart so as to extend the resilient tension member therebetween, and a reduction in tension applied to the slickline allows the first and second bodies to be urged together under the action of the resilient tension member.

21. A system according to claim 19, comprising a rack and pinion arrangement, wherein the first and second bodies and the actuator member are mechanically linked by the rack and pinion arrangement.

22. A system according to claim 19, wherein the tool comprises a position sensor for sensing the relative positions of at least two of the first and second bodies and the actuator member.

23. A system according to claim 19, wherein the first body comprises a first surface-engaging device for engaging a surface defining the elongated space and the second body comprises a second surface-engaging device for engaging the surface defining the elongated space.

24. A system according to claim 23, wherein the first and second surface-engaging devices are biased into engagement with the surface defining the elongated space.

25. A system according to claim 23, wherein the tool is configured to selectively disengage the first and second surface-engaging devices from the surface defining the elongated space.

26. A system according to claim 23, wherein the first surface-engaging device is configured to selectively rotate in a first direction of rotation relative to the first body to allow the first surface-engaging device to roll along the surface defining the elongated space in a permitted direction and the second surface-engaging device is configured to selectively rotate in the first direction of rotation relative to the second body to allow the second surface-engaging device to roll along the surface defining the elongated space in the permitted direction, and wherein the first surface-engaging device is configured to be selectively incapable of rotating in a second direction of rotation relative to the first body, the second direction of rotation being opposite to the first direction of rotation thereby preventing the first surface-engaging device from rolling along the surface defining the elongated space in a direction opposite to the permitted direction, and the second surface-engaging device is configured to be selectively incapable of rotating in the second direction of rotation relative to the second body thereby preventing the second surface-engaging device from rolling along the surface defining the elongated space in the direction opposite to the permitted direction.

27. A system according to claim 26, wherein the first and second surface-engaging devices comprise sprag wheels.

28. A system according to claim 26, wherein the tool is configured to reverse the permitted direction along which the first and second surface-engaging devices are permitted to roll relative to the surface defining the elongated space.

29. A system according to claim 1, comprising a winch tension sensor for sensing slickline tension adjacent to or in the vicinity of the winch, wherein the winch controller is configured to receive information from the winch tension sensor and to operate the winch according to the information received from the winch tension sensor.

30. A system according to claim 1, comprising an electrically conductive sensor element located in sufficient proximity to the slickline so that a bound electric field and/or a bound magnetic field extends between an electrically conductive core of the slickline and the sensor element to facilitate the coupling of a voltage signal between the core of the slickline and the sensor element, wherein the sensor element is electrically connected to the winch controller.

31. A system according to claim 19, wherein the first and second bodies and the actuator member are mechanically or hydraulically linked.

32. A system according to claim 23, wherein the first surface-engaging device is configured to selectively permit movement of the first body relative to the surface defining the elongated space in a permitted direction and to selectively prevent movement of the first body relative to the surface defining the elongated space in a direction opposite to the permitted direction, and wherein the second surface-engaging device is configured to selectively permit movement of the second body relative to the surface defining the elongated space in the permitted direction and to selectively prevent movement of the second body relative to the surface defining the elongated space in the direction opposite to the permitted direction.

33. A system according to claim 32, wherein the first surface-engaging device is selectively re-configurable so as to reverse the permitted direction along which the first body is permitted to move relative to the surface defining the elongated space, and wherein the second surface-engaging device is selectively re-configurable so as to reverse the permitted direction along which the second body is permitted to move relative to the surface defining the elongated space.

34. A system according to claim 1, wherein the tool is configured to actuate a further tool or move an object in the elongated space, wherein the tool is configured to move within the elongated space, wherein the tool is configured to propel a further tool within the elongated space, wherein the tool is configured to push and/or pull a further tool along the elongated space, or wherein the tool comprises a tractor which is capable of advancing within the elongated space according to changes in tension applied to the slickline by the winch.

* * * * *